US011686438B1

(12) United States Patent
Hong

(10) Patent No.: US 11,686,438 B1
(45) Date of Patent: Jun. 27, 2023

(54) LENS TO PRODUCE HIGH ANGLE OFF-AXIS LIGHT WITH WIDE BEAM WIDTH

(71) Applicant: Dialight Corporation, Farmingdale, NJ (US)

(72) Inventor: Qi Hong, Morganville, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 17/734,499

(22) Filed: May 2, 2022

(51) Int. Cl.

| | |
|---|---|
| ***F21V 5/04*** | (2006.01) |
| ***F21K 9/68*** | (2016.01) |
| ***F21V 7/00*** | (2006.01) |
| ***F21V 7/04*** | (2006.01) |
| ***F21V 7/06*** | (2006.01) |
| ***F21V 7/09*** | (2006.01) |
| *F21Y 115/10* | (2016.01) |

(52) U.S. Cl.
CPC ..... *F21K 9/68* (2016.08); *F21V 7/0066* (2013.01); *F21V 7/0091* (2013.01); *F21V 7/041* (2013.01); *F21V 7/048* (2013.01); *F21V 7/06* (2013.01); *F21V 7/09* (2013.01); *F21Y 2115/10* (2016.08)

(58) Field of Classification Search
None
See application file for complete search history.

(56) References Cited

U.S. PATENT DOCUMENTS

2018/0266654 A1* 9/2018 Sayers ..... F21V 5/04
2018/0292071 A1* 10/2018 Tarsa ..... F21V 5/08

FOREIGN PATENT DOCUMENTS

DE 202018107305 U1 * 4/2020 ..... F21V 5/04

* cited by examiner

*Primary Examiner* — Elmito Breval
(74) *Attorney, Agent, or Firm* — Tong, Rea, Bentley & Kim, LLC

(57) ABSTRACT

The present disclosure is directed to examples of an apparatus. In one embodiment, the apparatus includes a light entry segment that receives light emitted from a light emitting diode (LED), a total internal reflection (TIR) segment to reflect the light emitted from the light emitting diode towards an optical axis of the LED, and a light redirection segment to redirect the light emitted from the light emitting diode and the light reflected by the TIR segment at an angle greater than 45 degrees relative to the optical axis of the LED and greater than 90 degrees along a horizontal axis.

19 Claims, 12 Drawing Sheets

LENS TO PRODUCE HIGH ANGLE OFF-AXIS LIGHT WITH WIDE BEAM WIDTH

BACKGROUND

Luminaires can be used to illuminate an area. Luminaires can include various types of light sources such as incandescent bulbs or light emitting diodes (LEDs). Currently, LEDs are preferred due to lower energy usage and the ability to provide sufficient light output.

LEDs may emit light in a hemispherical pattern. Lenses and/or optics can be used to shape the pattern of light emitted from the LEDs. Typically, the optics shape the light emitted from the LEDs along the optical axes of the LEDs.

In addition, LEDs may use additional optics to redirect light in a desired direction to maximize the efficiency of the light output. A total internal reflective (TIR) lens is an example of an optic that can be used with LEDs to redirect light.

SUMMARY

In one embodiment, the present disclosure provides an apparatus. In one embodiment, the apparatus comprises a light entry segment that receives light emitted from a light emitting diode (LED), a total internal reflection (TIR) segment to reflect the light emitted from the light emitting diode towards an optical axis of the LED, and a light redirection segment to redirect the light emitted from the light emitting diode and the light reflected by the TIR segment at an angle greater than 45 degrees relative to the optical axis of the LED and greater than 90 degrees along a horizontal axis.

In one embodiment, the present disclosure provides another embodiment of an apparatus. In one embodiment, the apparatus comprises a substrate, a total internal reflection (TIR) lens formed below the substrate and around a light emitting diode (LED), a light redirection segment formed in the substrate, wherein a bottom of the light redirection is below a top surface of the substrate. The light redirection segment comprises a TIR surface and a light exiting surface.

In one embodiment, the present disclosure provides a luminaire. In one embodiment, the luminaire comprises at least one LED to emit light and a lens to redirect the light emitted from the at least one LED at an angle greater than 45 degrees relative to the optical axis of the LED and greater than 90 degrees along a horizontal axis. The lens comprises a substrate, a total internal reflection (TIR) lens formed below the substrate and around a light emitting diode (LED), and a light redirection segment formed in the substrate, wherein a bottom of the light redirection is below a top surface of the substrate. The light redirection segment comprises a TIR surface and a light exiting surface.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present disclosure provides a lens that can produce a high angle off-axis light with a wide beam width. As discussed above, luminaires can be used to illuminate an area. Luminaires can include various types of light sources such as incandescent bulbs or light emitting diodes (LEDs). Currently, LEDs are preferred due to lower energy usage and the ability to provide sufficient light output.

LEDs may emit light in a hemispherical pattern. Lenses and/or optics can be used to shape the pattern of light emitted from the LEDs. Typically, the optics shape the light emitted from the LEDs along the optical axes of the LEDs.

However, for some applications, it may be desirable to redirect the light from the LED in a wide beam width at a high angle off-axis direction, rather than in a general direction of the optical axis of the LED. For example, the luminaires may be located along the sides of streets, parking spaces, or other large areas that may be out of the way rather than straight down below the luminaires' locations.

The present disclosure provides a lens that can redirect light emitted from an LED to produce a high angle off-axis light. The lens can also produce a generally wide horizontal beam width while maintaining a narrow vertical beam width.

Figure 1:
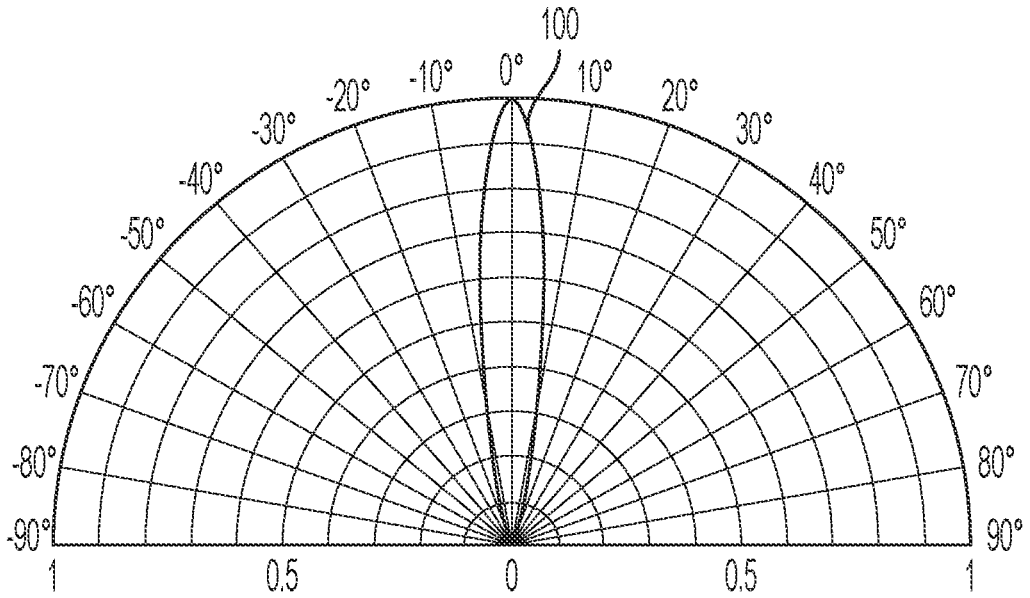
FIG. 1 depicts an example narrow width light beam of an LED light output.

FIG. 1 illustrates an example beam pattern 100. When an LED is located at 0, the optical axis of the LED may point at 0 degrees. With a collimating lenses, the beam pattern 100 may be collimated to be relatively narrow to +/−10 degrees of the optical axis at 0 degrees.

Figure 2:
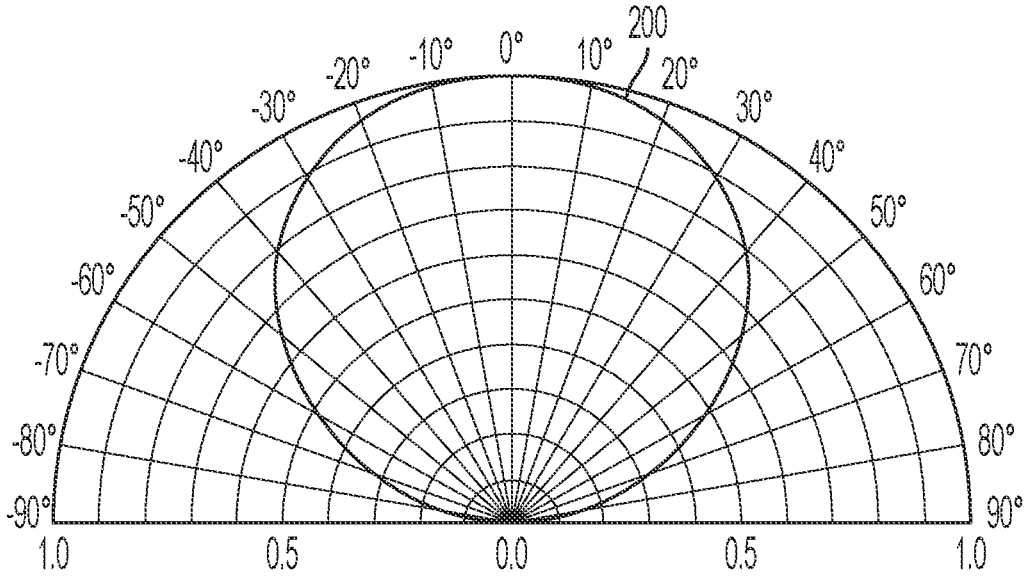
FIG. 2 depicts an example Lambertian light distribution of an LED light output.

FIG. 2 illustrates an example beam pattern 200. When an LED is located at 0, the optical axis of the LED may point at 0 degrees. Without any lenses, the LED may emit light in a Lambertian pattern. As can be seen, the LED may emit light radially outward in all directions.

The inverse-square law of light states that the illuminance on a plane is inversely proportional to the square of the distance between the source and the illuminated point, and is proportional to the cosine of the light incident angle. The relationship is shown by Equation 1 below:

$$E = \frac{I_\theta \cos\theta}{d^2}, \qquad \text{Equation 1}$$

where $I_\theta$ is the luminous intensity of the source in the direction of the illuminated point (e.g., along the optical axis of the LED), θ is the angle between the normal to the plane containing the illuminated point and the line joining the source to the illuminated point, and d is the distance to the illuminated point. To uniformly illuminate an area far away from a light pole, the light intensity profile is determined in accordance with Equation 2 shown below:

$$I_\theta = \frac{Ed^2}{\cos\theta}. \qquad \text{Equation 2}$$

Figure 3:
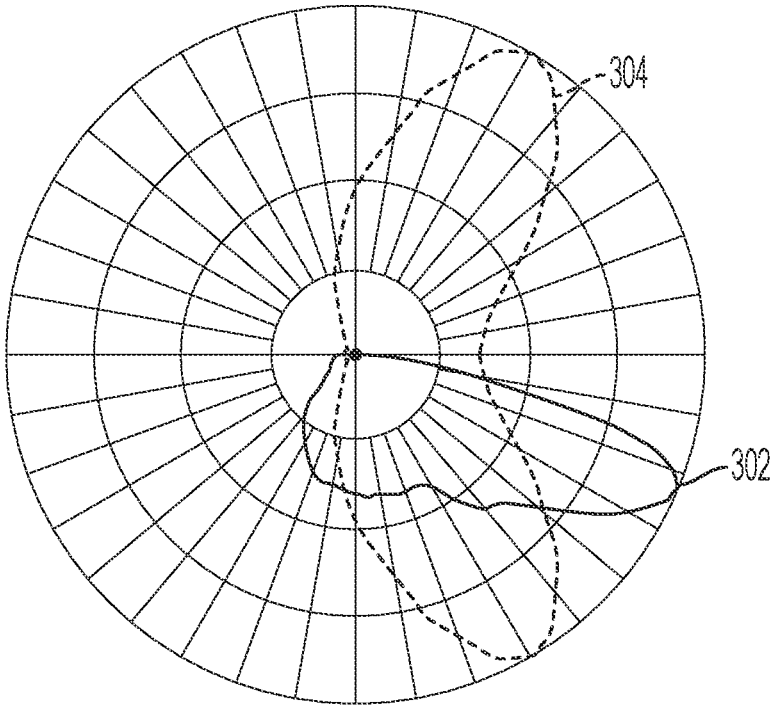
FIG. 3 depicts an example high angle off-axis asymmetrical and wide light beam emitted by an LED using a lens of the present disclosure.

FIG. 3 illustrates example beam patterns 302 and 304 generated by Equation 2 above. For example, an LED positioned at 0 and pointing downward in a luminaire may have a lens of the present disclosure that can generate the beam pattern 302 when viewing from the side of the luminaire. The LED positioned at 0 and pointing downward in a luminaire may have a lens of the present disclosure that can generate the beam pattern 304 when viewing from overhead.

The lens of the present disclosure can turn wide angle light emissions of the LED (e.g., as shown by FIG. 2) into a wider light beam pointing toward off-axis (e.g., as shown by the beam patterns 302 and 304), and be suitable to illuminate a street or parking spaces from a periphery. In one embodiment, the lens of the present disclosure may redirect light emitted by the LED to high angles (e.g., 45 degrees or greater from the optical axis of the LED) with a narrow vertical beam pattern (e.g., as low as +/−10 degrees relative to the optical axis). The lens of the present disclosure may also spread light with a relatively wide horizontal beam spread (e.g., up to +/−70 degrees) relative to the optical axis in a batwing pattern to provide wide coverage of a street or parking spaces.

Figure 4:
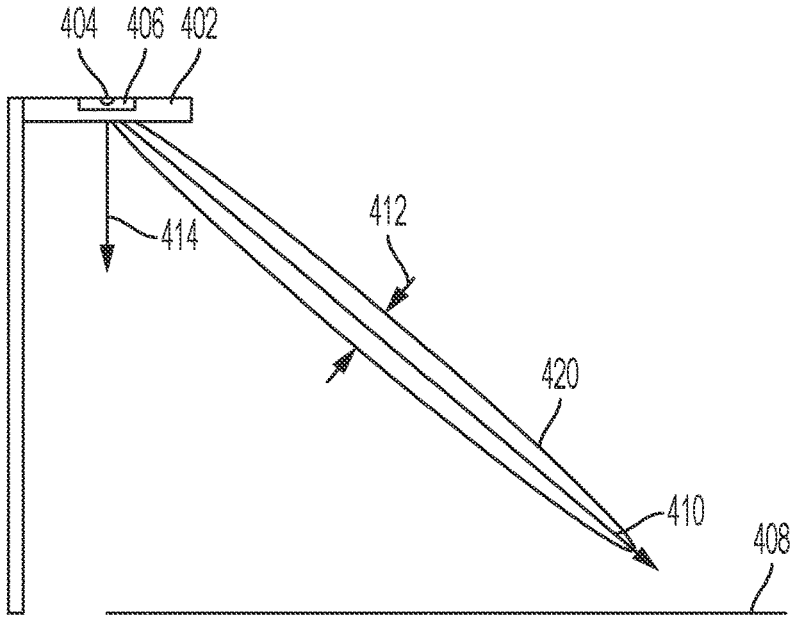
FIG. 4 depicts a block diagram of side view of a luminaire with a lens of the present disclosure used to illuminate a field and an example of a vertical beam spread emitted by the luminaire.

FIG. 4 illustrates an example luminaire 402 with an LED 404 and a lens 406 of the present disclosure. FIG. 4 illustrates a side view of the luminaire 402 on a pole located around a periphery of a street 408. Although a street 408 is used as an example target to be illuminated in FIGS. 4 and 5, it should be noted that the luminaire 402 may be used in other applications (e.g., parking spaces, or other large areas).

FIG. 4 illustrates the LED 404 pointed downward with an optical axis 414 that would be at 0 degrees. The lens 406 of the present disclosure may redirect light emitted by the LED 404 to high angles off-axis towards the street 408 as shown by a vertical beam pattern 420. An arrow 410 illustrates an example direction of the light redirected by the lens 406. In one embodiment, "high angles" may be defined as angles greater than 30 degrees relative to the optical axis 414 of the LED 404. In one embodiment, "high angles" may be defined as angles greater than 45 degrees relative to the optical axis 414.

The lens 406 may also collimate the light in a vertical direction. For example, the lens 406 may collimate the vertical beam pattern 420 to have a vertical beam spread 412 of the light to be from 10 degrees to 90 degrees, from 20 degrees to 70 degrees, or from 20 degrees to 50 degrees. Said another way, the vertical beam spread 412 may be from +/−5 degrees to +/−45 degrees relative to a central light axis of the vertical beam pattern 420 that is represented by the arrow 410. In one embodiment, the vertical beam spread 412 may be from +/−10 degrees to +/−35 degrees relative to the central light axis. In one embodiment, the vertical beam spread 412 may be from +/−10 degrees to +/−25 degrees relative to the central light axis.

Figure 5:
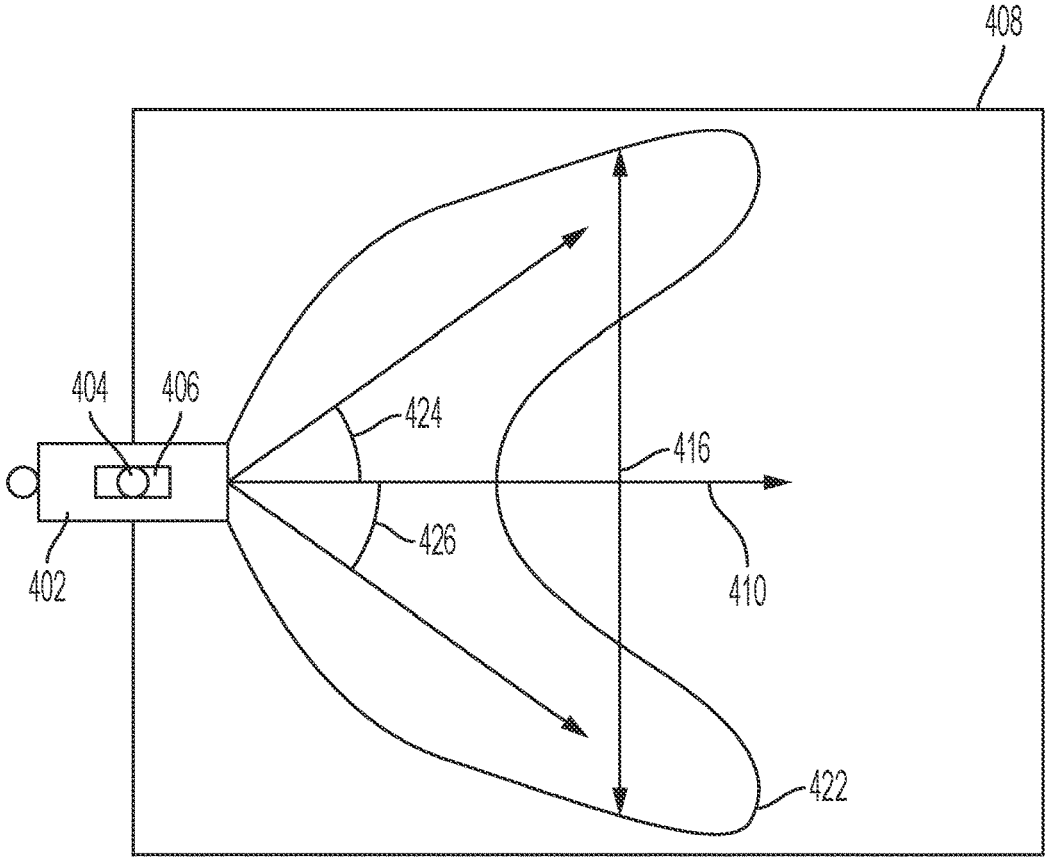
FIG. 5 depicts a block diagram of an overhead view of the luminaire with the lens of the present disclosure used to illuminate the field and an example of a horizontal beam spread emitted by the luminaire.

FIG. 5 illustrates an overhead view of the luminaire 402 looking down at the luminaire 402 and the street 408. The luminaire lens 406 may redirect light to have a horizontal beam pattern 422. As noted above, the lens 406 of the present disclosure may also be designed to spread light in a horizontal direction to provide more coverage of the street 408. Thus, the lens 406 may reduce light pollution in a vertical direction (e.g., a narrow vertical beam spread 412), but provide wide coverage in a horizontal direction (e.g., a wide horizontal beam spread 416).

FIG. 5 illustrates an example horizontal beam spread 416 of the horizontal beam pattern 422 relative to the central light axis that is represented by the arrow 410. The horizontal beam pattern 422 may have a batwing shape to provide maximum horizontal coverage.

In one embodiment, the horizontal beam spread 416 may be from 20 degrees to 150 degrees, from 40 degrees to 100 degrees, or from 50 degrees to 90 degrees. Said another way, the horizontal beam spread 416 may be from +/−10 degrees to +/−85 degrees relative to the central light axis of the light beam represented by the arrow 410. In one embodiment, the horizontal beam spread 416 may be from +/−20 degrees to +/−85 degrees relative to the central light axis. In one embodiment, the horizontal beam spread 416 may be from +/−25 degrees to +/−45 degrees relative to the central light axis.

Figure 6:
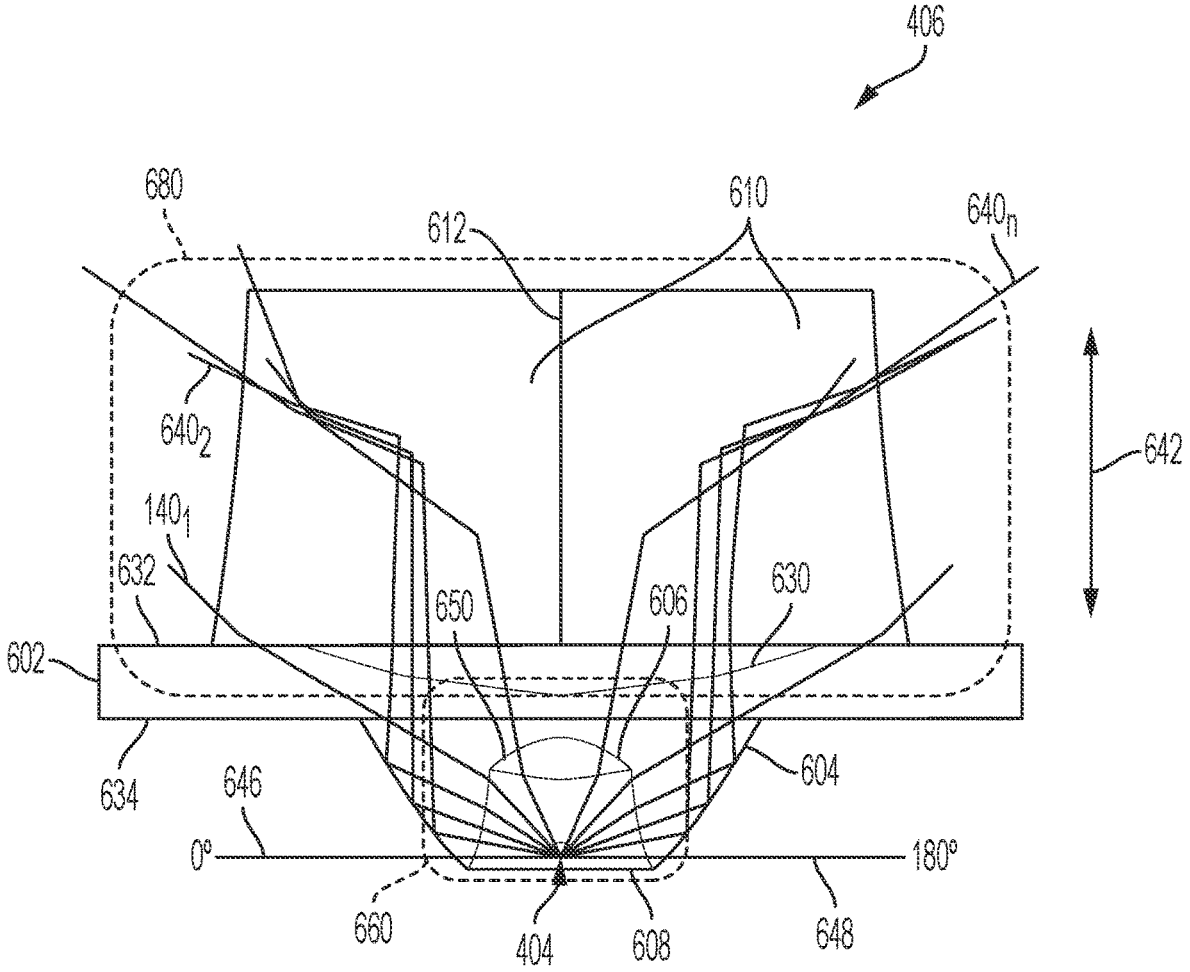
FIG. 6 depicts a cross-sectional side view of a lens of the present disclosure with example light ray traces.

FIG. 6 illustrates a front view of an example lens 406 of the present disclosure. In one embodiment, the lens 406 may be fabricated from an optically clear polymer or glass material. The lens 406 may be molded as a single piece to have the shape and features described herein. In another embodiment, the lens 406 may be fabricated by coupling the various features together to form the shapes and features described herein. Optically clear may be defined as any material that allows more than 50% of visible light emitted by the LED 404 to pass through.

In one embodiment, the lens 406 may include a substrate 602. The substrate 602 may have a top surface 632 and a bottom surface 634. A total internal reflection (TIR) lens 604 may be formed below the bottom surface 634 of the substrate 602. The TIR lens 604 may be formed around the LED 404. The TIR lens 604 may form a TIR segment 660 of the lens 406.

In one embodiment, the TIR lens 604 may have a general conical shape. The outer surface of the TIR lens 604 may be angled and/or curved to reflect light emitted by the LED 404 internally and back towards the top surface 632 of the substrate 602. Said another way, the TIR lens 604 may reflect light emitted by the LED 404 in a direction similar to the optical axis 414 of the LED 404.

The angle and/or amount of curvature of the outer surface of the TIR lens 604 may be a function of a size of the lens 406 and/or the size of the LED 404. The TIR lens 604 may be designed to ensure that light rays that strike the outer surface of the TIR lens 604 are redirected as shown by the example light rays $\mathbf{640}_1$ to $\mathbf{640}_n$ (hereinafter also referred to a light ray 640 or collectively as light rays 640).

In one embodiment, a light entry segment 650 may receive light emitted by the LED 404. The light entry segment 650 may be formed by a rounded or curved inner wall 608 of the TIR lens 604. The rounded inner wall 608 may be an inner surface that is formed around the LED 404. The light entry segment 650 may also include a conic surface 606 coupled to the rounded inner wall 608. In one embodiment, the conic surface 606 may be below the bottom surface 634 of the substrate 602.

In one embodiment, the conic surface 606 may receive light emitted by the LED 404 at angles from about 60 degrees to about 120 degrees. In one embodiment, the rounded inner wall 608 may receive light emitted by the LED 404 from about 0 degrees to 60 degrees and from about 120 degrees to 180 degrees. The angles may be measured where 0 degrees is located to the left of the LED 404 as shown by a line 646 and 180 degrees is located to the right of the LED 404 as shown by a line 648.

In one embodiment, the lens 406 includes a light redirection segment 680. The light redirection segment 680 may include a light exiting surface 610 and a TIR surface illustrated in FIGS. 7 and 8. The light exiting surface 610 may include separate surfaces that are connected along a center edge 612, or may be formed as a single continuous surface having a semi-circle or parabolic shape or curve. The light redirecting surface 610 may be located above the top surface 632 of the substrate 602. The light redirecting surface 610 may collect light emitted by the LED 404 and the light redirected by the TIR segment 660 of the TIR lens 604 and redirect the light at a high angle in a collimated vertical beam spread, as shown by the vertical beam pattern 420 in FIG. 4 and in a wide horizontal batwing pattern, as shown by the horizontal beam spread 422 in FIG. 5.

In one embodiment, the lens 406 may also include a groove 630 formed in the top surface 632 of the substrate 602. The groove 630 may be located in the top surface 632 of the substrate 602 along the front of the light exiting surface 610 and/or along the back of the TIR surface 614. The groove 630 may have a concave shape. The groove 630 is shaped to allow some of the light rays 640 that are redirected by the light redirection segment 680 to exit unimpeded. In other words, the groove 630 prevents some of the light rays 640 from being blocked by the substrate 602. Without the groove 630, the substrate 602 may have a sharp corner and a vertical wall. A vertical wall could block some of the light emitted from the lower part of the light redirection segment 680.

In one embodiment, the lens 406 may also be designed to have a relatively low profile (e.g., a shorter height in the dimension shown by the line 642). The light redirection segment 680 may be formed by the TIR surface 614 and the light exiting surface 610 such that a bottom of the light redirection segment 680 is below the top surface 632 of the substrate 602. The conic surface 606 may be positioned to be below the bottom surface 634 to reduce the height of the light redirection segment 612. Thus, a lower overall height profile for the lens 406 can be achieved.

Figure 7:
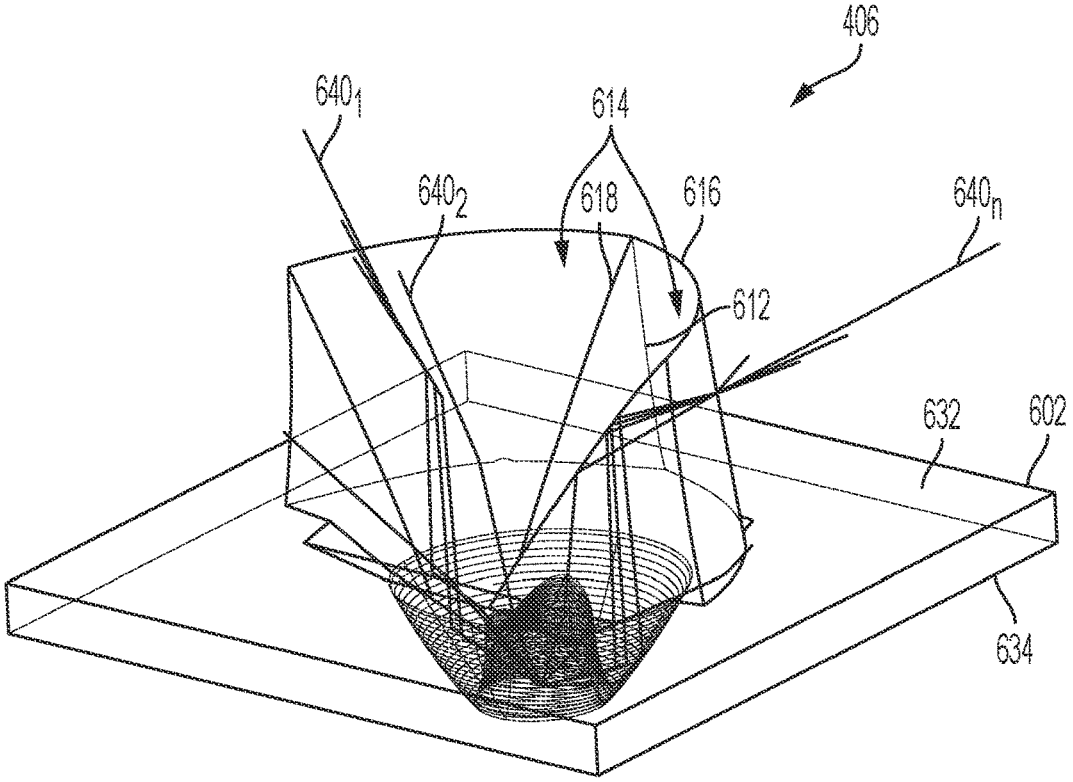
FIG. 7 depicts an isometric view of the lens of the present disclosure with example light ray traces.

FIG. 7 illustrates an isometric back view of the example lens 406. FIG. 7 illustrates a TIR surface 614 of the light redirection segment 680. The TIR surface 614 may have a generally conic shape and may be coupled to or formed along a top edge 616 of the light exiting surface 610.

In one embodiment, the TIR surface 614 may include a plurality of TIR surfaces 614 that are coupled together along an inner center edge 618 to the light exiting surface 610. In one embodiment, the TIR surface 614 may be formed as a single continuous piece that forms the conic shape, as shown in FIG. 7. In one embodiment, the TIR surface 614 may meet the light exiting surface 610 at a peak (e.g., the top edge 616) of the light exiting surface 610 to form a cross-sectional prism or triangular type shape.

In one embodiment, the TIR surface 614 may be shaped and angled to internally reflect light rays 640 at a high angle and to collimate the light rays 640 in a vertical direction and form a wide bat wing pattern in a horizontal direction. The light rays 640 may be reflected by the TIR surfaces 614, and the light rays 640 may exit via the light exiting surface 610. The light exiting surface 610 may be shaped and/or angled to allow the light rays 640 to pass through.

Figure 8:
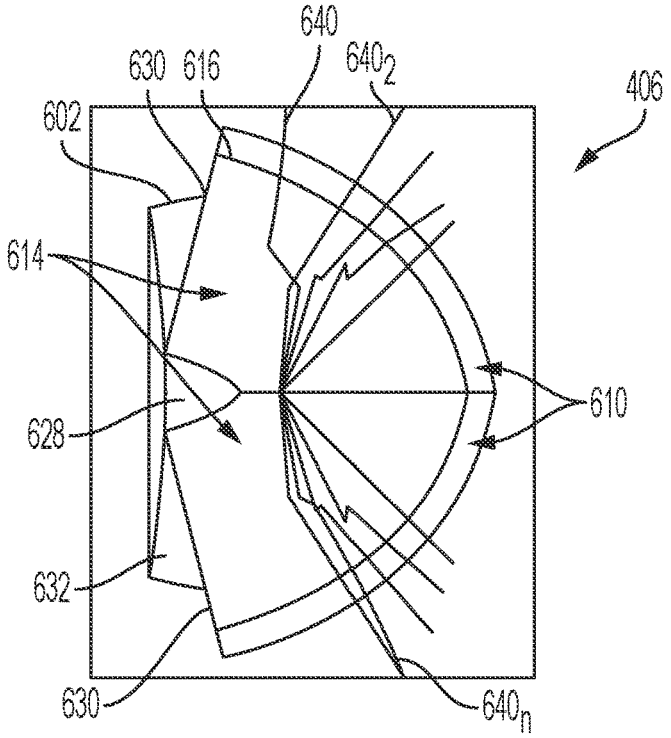
FIG. 8 depicts an overhead view of the lens of the present disclosure with example light ray traces

FIG. 8 illustrates a top or overhead view of the example lens 406. As discussed above, the light redirection segment 680 may have a curved shape. For example, as can be seen from the overhead view, the top edge 616 may have a semi-circular or parabolic shape. In one embodiment, when multiple light exiting surfaces 610 and multiple TIR surfaces 614 are combined, the top edge 616 may have an arrowhead shape.

Said another way, the light exiting surface 610 may have a curved surface along a horizontal plane (e.g., the top surface 632 of the substrate 602 being the horizontal plane). The TIR surface 614 may be coupled to an inner side of the curved surface of the light exiting surface 610.

Figure 14:
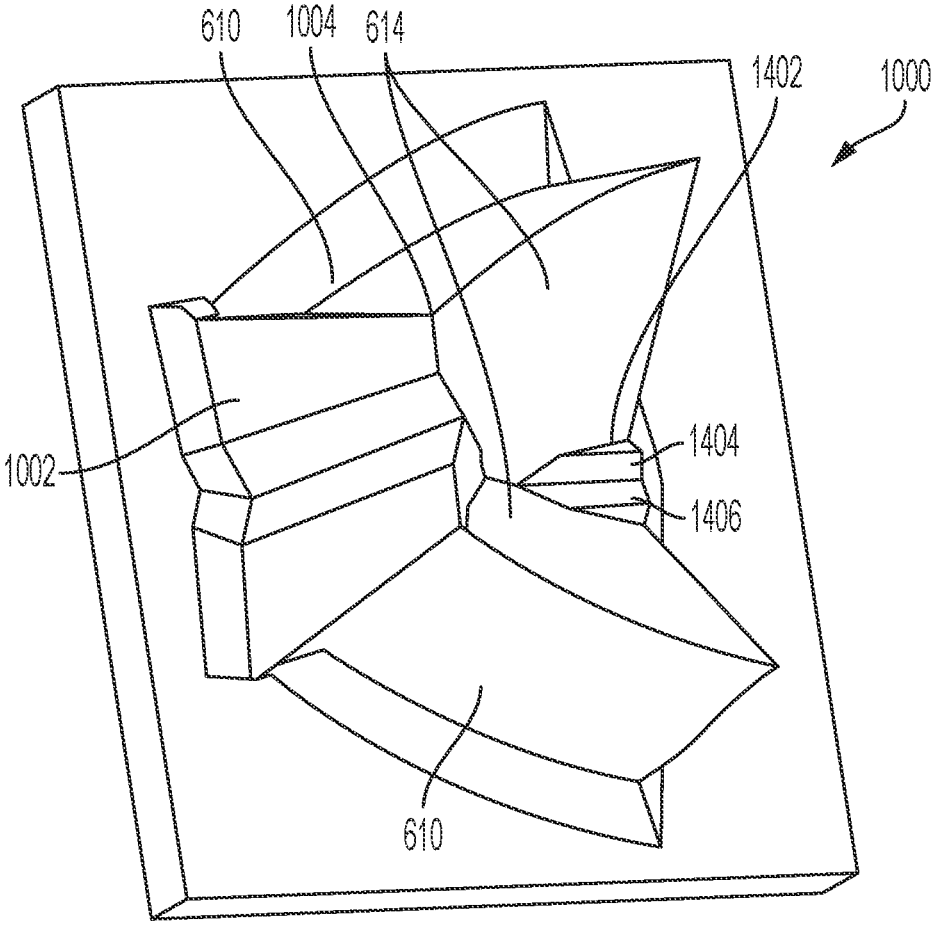
FIG. 14 depicts an isometric view of another example lens with a refractive feature of the present disclosure.

FIG. 8 also illustrates an opening 628 that is formed by a separation of the opposing ends 630 of the TIR surfaces 614. In other words, some of the top surface 632 of the substrate 602 may be visible between the opposing ends 630 of the TIR surfaces 614. In some embodiments, a narrow beam of light may exit through the opening 628. This may create hot spots on the target surface that is being illuminated directly below the lens 406. In one embodiment, a refractive feature may be added in the opening 628 to help spread the light to preferred directions and target surfaces to avoid creating hot spots. The refractive feature is illustrated in FIG. 14 and discussed in further detail below.

Figure 9:
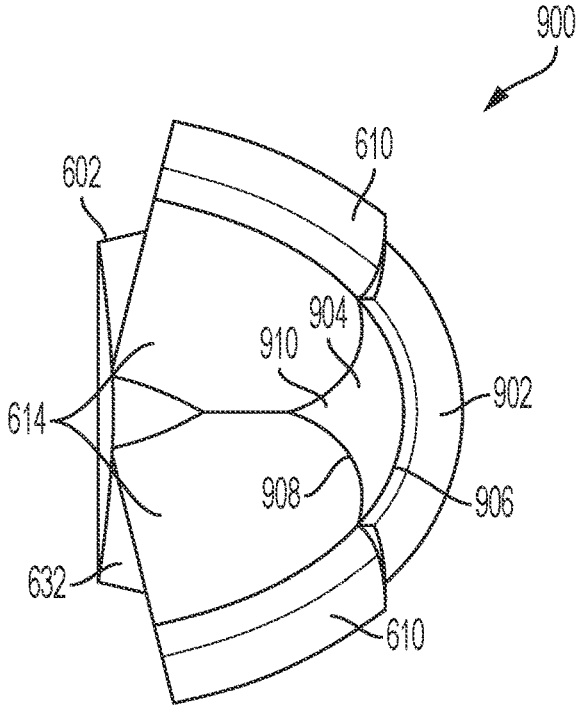
FIG. 9 depicts an overhead view of another example lens of the present disclosure.
Figure 10:
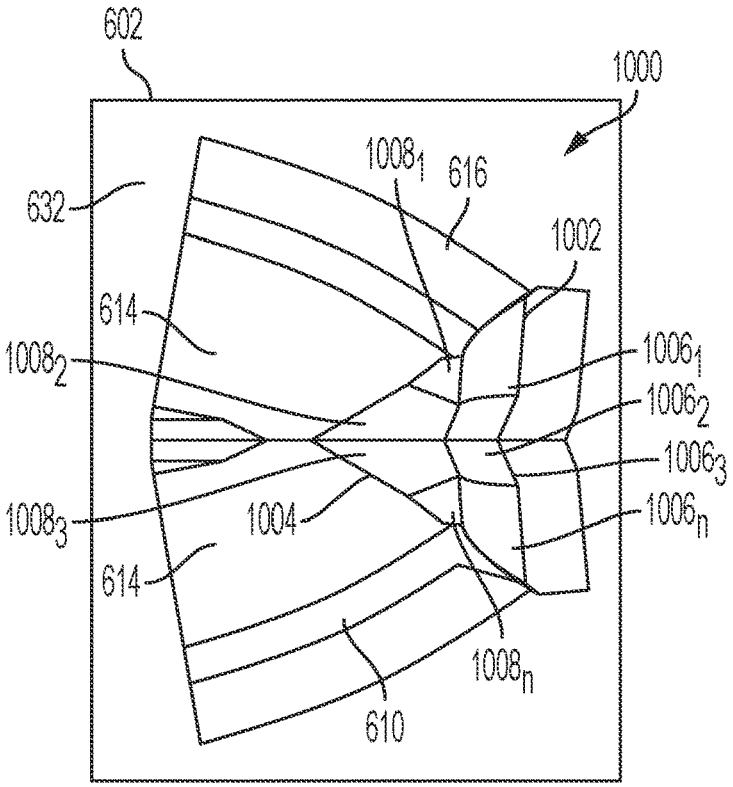
FIG. 10 depicts an overhead view of another example lens of the present disclosure.

FIGS. 9 and 10 illustrate different embodiments of the lens 406 that include different possible shapes for the light redirections segment 680. FIG. 9 illustrates an example lens 900. For example, the lens 900 may be formed on the top surface 632 of the substrate 602. The lens 900 may include the light exiting surfaces 610 and the TIR surfaces 614. The light exiting surfaces 610 and the TIR surfaces 614 may be curved, as discussed above.

However, the lens 900 may include an additional top TIR surface 904 and an additional front light exiting surface 902. For example, rather than having a continuous top edge 616, the center front portion of the top edge 616 may be replaced by a third TIR surface 904. The third TIR surface 904 may have a flat top surface and a curved front side 906. The third TIR surface 904 may have curved back sides 608 and 610 that are coupled to the opposing TIR surfaces 614. The third TIR surface 904 may help to redirect more light emitted from the LED 404 towards the front side or the front light exiting surface 902. In other words, the horizontal beam pattern of the lens 900 may be more semi-circular, rather than having the bat wing shape as the lens 406.

In one embodiment, the third or top TIR surface 904 may have a tilt angle. The tilt angle may be measured relative to a horizontal plane that is parallel with the top surface 632 of the substrate 602. In one embodiment, the tilt angle of the TIR surface 904 may be 45 degrees or greater so that the light emitted from the LED 404 is directed away from the lens 900 instead of being reflected back into the lens 900.

FIG. 10 illustrates an example lens 1000. For example, the lens 1000 may be formed on the top surface 632 of the substrate 602. The lens 1000 may include the light exiting surfaces 610 and the TIR surfaces 614. The light exiting surfaces 610 and the TIR surfaces 614 may be curved, as discussed above.

However, the lens 1000 may include an additional top TIR surface 1004 and an additional front light exiting surface 1002. For example, rather than having a continuous top edge 616, the center front portion of the top edge 616 may be replaced by a third TIR surface 1004. The third TIR surface 1004 may be formed from multiple sub-surfaces $\mathbf{1008}_1$ to $\mathbf{1008}_n$ (also referred to herein collectively as sub-surfaces 1008). The sub-surfaces 1008 may be coupled together at various angles. The sub-surfaces 1008 can be angled to redirect light in desired directions towards the front light exiting surface 1002.

In one embodiment, the front light exiting surface 1002 may also be formed from a plurality of sub-surfaces $\mathbf{1006}_1$ to $\mathbf{1006}_n$ (also referred to herein collectively as sub-surfaces 1006). The number of sub-surfaces 1006 may correspond to the number of sub-surfaces 1008. The sub-surfaces 1006 and 1008 may be coupled together to have a cross-sectional zig-zag pattern or an alternating series of peaks and valleys.

The third TIR surface 1004 may help to redirect more light emitted from the LED 404 towards the front side or the front light exiting surface 1002. In other words, the horizontal beam pattern of the lens 1000 may be more semi-circular, rather than having the bat wing shape as the lens 406.

Figure 11:
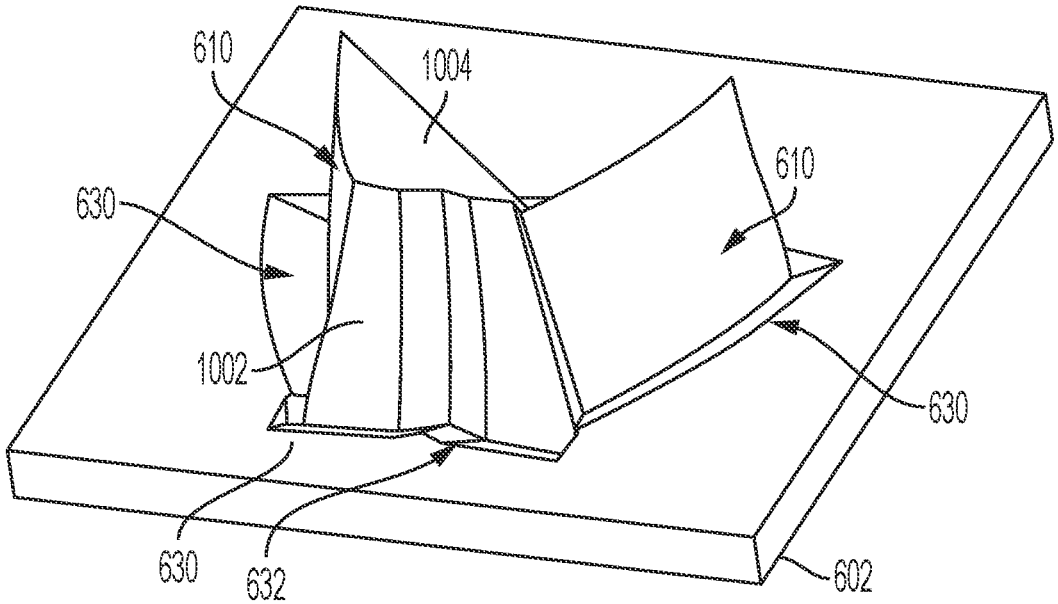
FIG. 11 depicts an isometric view of another example lens of the present disclosure.

FIG. 11 illustrates a top isometric view of the lens 1000. In one embodiment, the lens 1000 may also include grooves 630 similar to the lens 406. The grooves 630 of the lens 1000 may include multiple groove sections around the different sub-surfaces 1006 of the additional front light exiting surface 1002. The lens 1000 may also include grooves 630 along a front of the light exiting surfaces 610.

Figure 12:
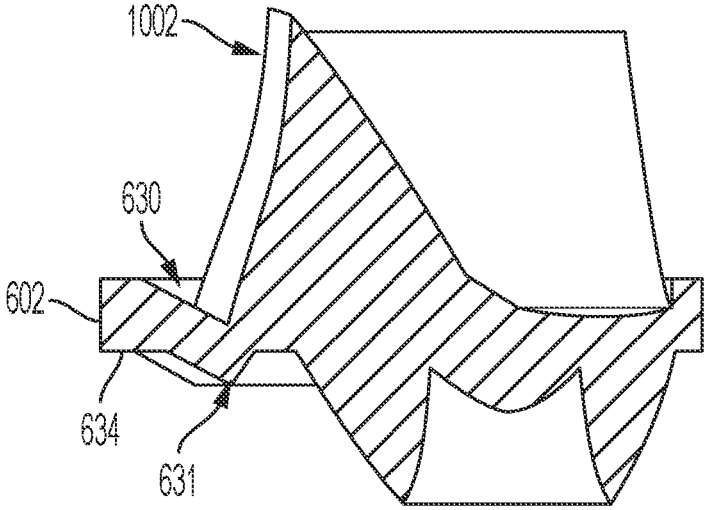
FIG. 12 depicts a side cross-sectional view of another example lens of the present disclosure with a front groove.

FIG. 12 illustrates a cross-sectional view of the lens 1000. The cross-sectional view of the lens 1000 illustrates the groove 630 formed in front of the additional front light exiting surface 1002. In one embodiment, the substrate 602 may also include a ridge 631 on the bottom side 634. The ridge 631 can be included when a minimum thickness of the substrate 602 is maintained. The ridge 631 may be formed opposite the groove 630. In other words, the groove may be formed by the apex or bottom most point of the groove 630.

Figure 13:
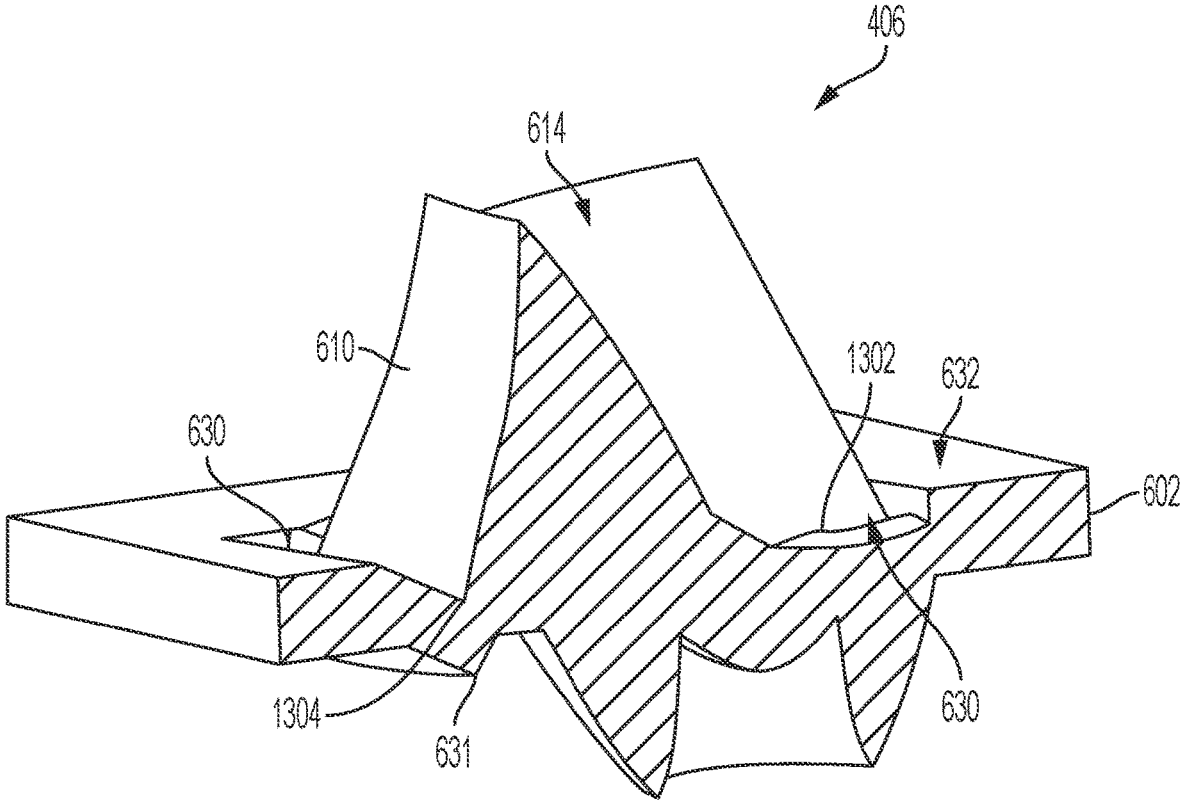
FIG. 13 depicts a side cross-sectional view of another example lens of the present disclosure to illustrate how the TIR surface extends below a top surface of the substrate.

FIG. 13 illustrates a side cross-sectional view of the lens 406. FIG. 13 illustrates how a bottom 1302 of the TIR surface 614 extends below a top surface 632 of the substrate 602. The groove 630 may be formed around the bottom surface 1302 of the TIR surface 614 and a bottom surface 1304 of the light exiting surface 610.

As discussed above, in some embodiments of the lens (e.g., the lens 900), the lens may have a third TIR surface 904. The third TIR surface 904 may be tilted to direct light away from the lens. The tilt may increase the overall height (e.g., as measured by a dimension along the line 642 in FIG. 6) of the lens. The grooves 630 may be included to also reduce the overall height of the lens when using the third TIR surface 904.

FIG. 14 illustrates an isometric view of the example lens 1000 with a refractive feature 1402 of the present disclosure. Although the refractive feature 1402 is shown with the lens 1000, it should be noted that the refractive feature 1402 may also be deployed within the opening 628 in the lens 406 or 900.

As noted above, without the refractive feature 1402, a narrow beam of light may pass through the opening 628, creating a hot spot. The refractive feature 1402 may redirect the light emitted through the opening 628 to eliminate the hot spot and to improve uniformity of illuminance of the lenses 406, 900, and 1000.

In one embodiment, the refractive feature 1402 may include a plurality of sub-surfaces 1404 and 1406 that are angled together to redirect and spread the light in desired directions. Although two sub-surfaces 1404 and 1406 are illustrated in FIG. 14, it should be noted that any number of sub-surfaces may be deployed for the refractive feature 1402.

Figure 15:
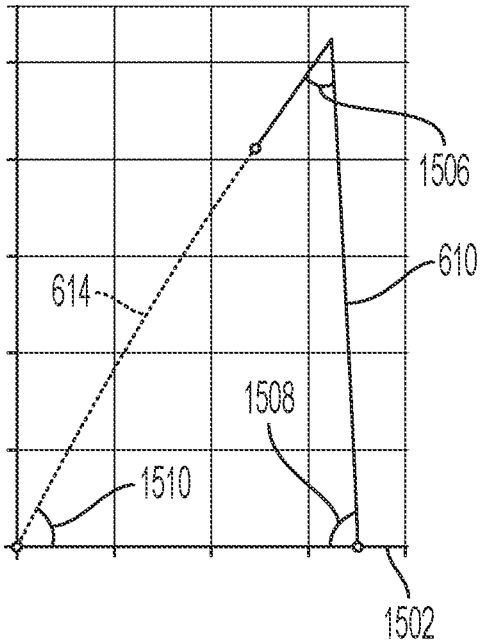
FIG. 15 depicts a first example vertical cross-section of the TIR surfaces of the present disclosure.
Figure 16:
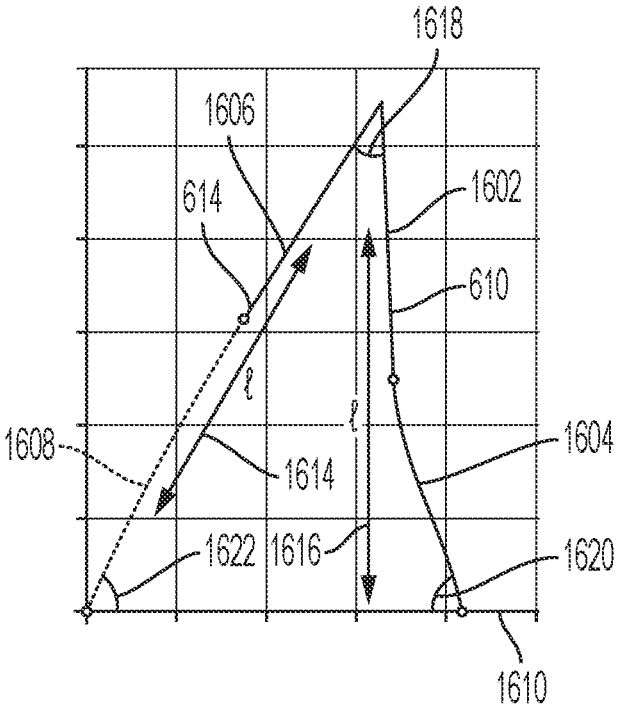
FIG. 16 depicts a second example vertical cross-section of the TIR surfaces of the present disclosure.
Figure 17:
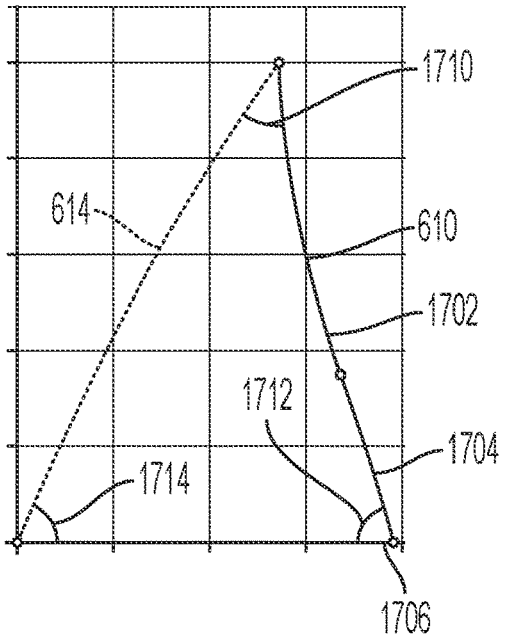
FIG. 17 depicts a third example vertical cross-section of the TIR surface of the present disclosure.

FIGS. 15, 16, and 17 show an example cross-section of the light exiting surface 610 and the TIR surface 614. The light exiting surface 610 and the TIR surfaces 614 may be straight, curved, or a combination of straight and curved surfaces in a vertical plane or height (e.g., the dimension along the line 642). FIG. 15 illustrates an example light redirection segment 680 with the light exiting surface 610 and the TIR surface 614.

FIG. 15 illustrates an example where the TIR surface 614 has a straight surface in the vertical plane and the light exiting surface 610 has a straight surface in the vertical plane. In one embodiment, the light exiting surface 610 may be approximately perpendicular to the plane 1502. However, the TIR surface 614 and the light exiting surface 610 may be curved along the horizontal plane when looking from above the light redirection segment 680, as illustrated in FIG. 8.

In one embodiment, the light exiting surface 610 may be positioned such that an angle 1508 is from about 80 degrees to about 90 degrees relative to the plane 1502. In one embodiment, the TIR surface 614 may be positioned at an angle 1510 that is less than the angle formed by the light exiting surface 610 and the plane 1502. The angle 1510 may be greater than or equal to 45 degrees to ensure that the light rays 640 that are reflected are redirected away from the lens 406 and not back towards the lens 406. In one embodiment, the TIR surface 614 and the light exiting surface 610 may meet to form an angle 1506 that is less than 90 degrees.

FIG. 16 illustrates an example light redirection segment 680 with the TIR surface 614 and the light exiting surface 610 that are curved in the vertical plane. FIG. 16 illustrates an example where the TIR surface 614 has a combination of a straight surface segment 1606 and a curved surface segment 1608 in the vertical plane, and the light exiting surface 610 has a combination of a straight surface segment 1602 and a curved surface segment 1604 in the vertical plane. In one embodiment, about 5% to 95% of a length 1614 of the TIR surface 614 may be the curved surface segment 1608, and the remainder of the length 1614 may be the straight surface segment 1606. In one embodiment, the curved surface segment 1608 may be about 50% of the length 1614 of the TIR surface 614 and 50% the straight surface segment 1606.

In one embodiment, about 5% to 95% of a length 1616 of the light exiting surface 610 may be the curved surface segment 1604, and the remainder of the length 1616 may be the straight surface segment 1602. In one embodiment, the curved surface segment 1604 may be about 50% of the length 1616 of the light exiting surface 610 and 50% the straight surface segment 1602.

In one embodiment, the light exiting surface 610 may be approximately perpendicular to the plane 1610. However, the TIR surface 614 and the light exiting surface 610 may be curved along the horizontal plane when looking from above the light redirection segment 680, as illustrated in FIG. 8.

In one embodiment, the light exiting surface 610 may be positioned such that an angle 1620 is from about 40 degrees to about 90 degrees relative to the plane 1610. In one embodiment, the TIR surface 614 may be positioned at an angle 1622 that is less than the angle formed by the light exiting surface 610 and the plane 1610. The angle 1622 may be greater than or equal to 45 degrees to ensure that the light rays 640 that are reflected are redirected away from the lens 406 and not back towards the lens 406. In one embodiment, the TIR surface 614 and the light exiting surface 610 may meet to form an angle 1618 that is less than 90 degrees.

FIG. 17 illustrates an example light redirection segment 680 with the TIR surface 614 and the light exiting surface 610 that are curved in the vertical plane. FIG. 17 illustrates an example where the entire length of the TIR surface 614 is curved in the vertical plane and the entire length of the light exiting surface 610 is also curved. In one embodiment, the curved light exiting surface 610 may be made from a combination of different curved segments 1702 and 1704. The segments 1702 and 1704 may be curved in opposite directions. For example, the segment 1702 may have a slight concave curvature and the segment 1704 may have a slight convex curvature.

In one embodiment, the light exiting surface 610 may be positioned such that an angle 1712 is from about 40 degrees to about 90 degrees relative to the plane 1706. In one embodiment, the TIR surface 614 may be positioned at an angle 1714 that is less than the angle formed by the light exiting surface 610 and the plane 1706. The angle 1714 may be greater than or equal to 45 degrees to ensure that the light rays 640 that are reflected are redirected away from the lens 406 and not back towards the lens 406. In one embodiment, the TIR surface 614 and the light exiting surface 610 may meet to form an angle 1710 that is less than 90 degrees.

Figure 18:
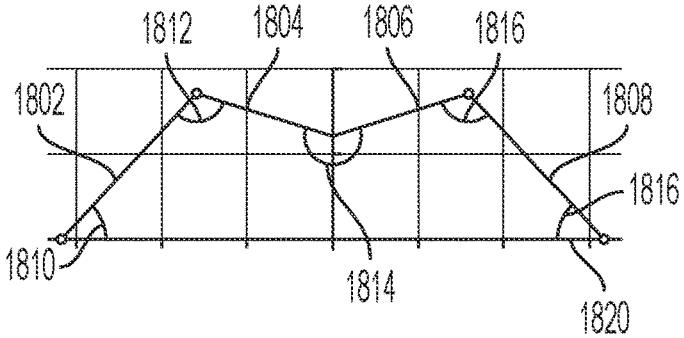
FIG. 18 depicts a first example vertical cross-section of the refractive feature of the present disclosure.
Figure 19:
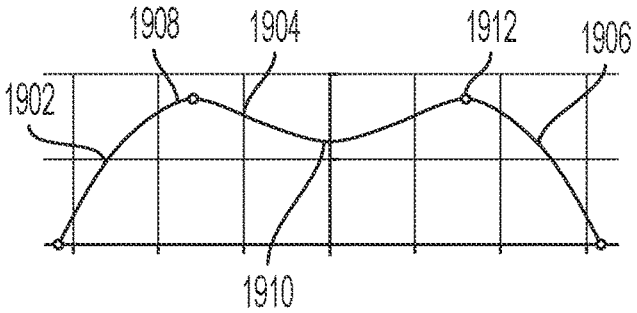
FIG. 19 depicts a second example vertical cross-section of the refractive feature of the present disclosure.
Figure 20:
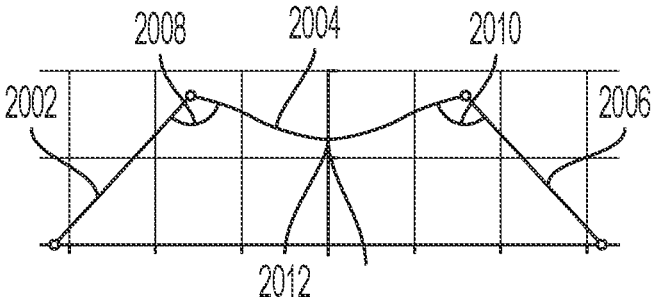
FIG. 20 depicts a third example vertical cross-section of the refractive feature of the present disclosure.

FIGS. 18, 19, and 20 illustrate different example cross-sectional views of the refractive feature 1402 illustrated in FIG. 14. FIG. 18 illustrates an example of the refractive feature 1402 that includes all straight sub-surfaces 1802, 1804, 1806, and 1808. In one embodiment, the sub-surfaces 1802, 1804, 1806, and 1808 may be coupled together to form a combination of peaks and valleys and/or acute and obtuse angles to spread the light into desired directions. For example, the refractive feature 1402 may have two peaks formed by angles 1812 and 1816 and a valley formed by an angle 1814.

The sub-surface 1802 may form an angle 1810 that is less than 90 degrees with the plane 1820 and an angle 1812 that is less than 180 degrees with a first end of the sub-surface 1804. The second end of the sub-surface 1804 may form an angle 1814 that is greater than 180 degrees with a first end of the sub-surface 1806. The second end of the sub-surface 1806 may form an angle 1816 that is less than 180 degrees with a first end of the sub-surface 1808. The second end of the sub-surface 1808 may form an angle that is less than 90 degrees with the plane 1820. Although FIG. 18 illustrates a shape formed by four separate sub-surfaces, it should be noted that the refractive feature 1402 may be formed with a single continuous surface formed having a shape similar to the shape illustrated in FIG. 18.

FIG. 19 illustrates an example refractive feature 1402 that includes all curved sub-surfaces 1902, 1904, and 1906. An end of the sub-surface 1902 and an end of the sub-surface 1904 may be coupled together to form a convex curve or peak 1908. The end of the sub-surface 1906 and the end of the sub-surface 1904 may be coupled together to form a convex curve or peak 1912. The sub-surface 1904 may have a concave curve at approximately the center of the sub-surface 1904 to form the valley or concave curve 1910. Although FIG. 19 illustrates the refractive feature 1402 as three separate curved sub-surfaces 1902, 1904, and 1906, it should be noted that the a single continuous curved surface may be formed that has a shape similar to the shape illustrated in FIG. 19.

FIG. 20 illustrates an example refractive feature 1402 that includes a combination of straight sub-surfaces 2002 and 2006 and a curved sub-surface 2004. An end of the sub-surface 2002 and a first end of the curved sub-surface 2004 may be coupled together to form a convex curve or an angle 2008 that is less than 180 degrees. The point of the angle 2008 may form a first peak. An end of the sub-surface 2006 and a second end of the curved sub-surface 2004 may be coupled together to form a convex curve or an angle 2010 that is less than 180 degrees. The point of the angle 2010 may form a second peak. The curved sub-surface 2004 may have a concave curve at approximately the center of the sub-surface 2004 to form the valley or concave curve 2012. Although FIG. 20 illustrates the refractive feature 1402 as three separate straight sub-surfaces 2002 and 2006 and a curved sub-surface 2004, it should be noted that the a single continuous curved surface may be formed that has a shape similar to the shape illustrated in FIG. 20.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus, comprising:

a light entry segment that receives light emitted by a light emitting diode (LED);

a total internal reflection (TIR) segment to reflect the light emitted by the light emitting diode towards an optical axis of the LED;

a light redirection segment to redirect the light emitted by the light emitting diode and the light reflected by the TIR segment at an angle greater than 45 degrees relative to the optical axis of the LED and greater than 90 degrees along a horizontal axis in a batwing shape; and a substrate located between the TIR segment and the light redirection segment, wherein a groove is formed below a top surface of the substrate and in front of an outer side of the light redirection segment.

2. The apparatus of claim 1, wherein the light redirection segment collimates a vertical beam spread of the light emitted by the light emitting diode and the light reflected by the TIR segment that is redirected from 10 degrees to 90 degrees.

3. The apparatus of claim 1, wherein the light entry segment comprises:

a rounded inner wall; and a conic surface coupled to the rounded inner wall.

4. The apparatus of claim 1, wherein the light redirection segment comprises:

a TIR surface; and a light exiting surface.

5. The apparatus of claim 4, wherein the light exiting surface comprises a curved surface along a horizontal plane.

6. The apparatus of claim 5, wherein the TIR surface comprises a conic shape coupled to an inner side of the curved surface.

7. The apparatus of claim 5, wherein the TIR surface comprises a separation between opposite ends of the TIR surface.

8. The apparatus of claim 7, further comprising:

a refractive member located in the separation between the opposite ends of the TIR surface.

9. The apparatus of claim 4, wherein the TIR surface comprises:

a top TIR surface; and opposing sideward TIR surfaces.

10. The apparatus of claim 9, wherein the top TIR surface comprises a plurality of top TIR sub-surfaces.

11. The apparatus of claim 10, wherein the light exiting surface comprises a plurality of light exiting sub-surfaces.

12. The apparatus of claim 1, further comprising:

a ridge on a bottom surface of the substrate and located below an apex of the groove.

13. The apparatus of claim 1, further comprising:

a TIR surface groove formed below a top surface of the substrate and behind the light redirection segment.

14. An apparatus, comprising:

a substrate;

a total internal reflection (TIR) lens formed below the substrate and around a light emitting diode (LED); and a light redirection segment formed in the substrate, wherein a bottom of the light redirection segment is below a top surface of the substrate, wherein the light redirection segment comprises:

a TIR surface; and a light exiting surface.

15. The apparatus of claim 14, wherein the TIR surface comprises:

a top TIR surface; and opposing sideward TIR surfaces.

16. The apparatus of claim 15, wherein the top TIR surface comprises a plurality of top TIR sub-surfaces.

17. The apparatus of claim 16, wherein the light exiting surface comprises a plurality of light exiting sub-surfaces.

18. A luminaire, comprising:

at least one light emitting diode (LED) to emit light; and a lens to redirect the light emitted by the at least one LED at an angle greater than 45 degrees relative to an optical axis of the LED and greater than 90 degrees along a horizontal axis, the lens comprising:

a substrate;

a total internal reflection (TIR) lens formed below the substrate and around the at least one LED; and a light redirection segment formed in the substrate, wherein a bottom of the light redirection segment is below a top surface of the substrate, wherein the light redirection segment comprises:

a TIR surface; and a light exiting surface.

19. The luminaire of claim 18, wherein the light emitted by the at least one LED that is redirected from the lens is spread to have a batwing horizontal beam pattern.

* * * * *